United States Patent [19]

Belanger et al.

[11] Patent Number: 4,941,228

[45] Date of Patent: Jul. 17, 1990

[54] FASTENING MECHANISM FOR SQUEEGEE HOLDER

[76] Inventors: Daniel J. Belanger; Frank A. Petracek, both of 537 Moorpark #128, Moorpark, Calif. 93021

[21] Appl. No.: 282,027

[22] Filed: Dec. 9, 1988

[51] Int. Cl.[5] ..... A47L 13/11

[52] U.S. Cl. ..... 15/245; 15/121

[58] Field of Search ..... 15/245, 176.6, 178, 15/150, 117, 121, 146, 145, 250.32, 250.36

[56] References Cited

U.S. PATENT DOCUMENTS

| | | | |
|---|---|---|---|
| 674,524 | 5/1901 | Svenson | 15/245 X |
| 2,261,475 | 11/1941 | Kautenberg | 15/245 |
| 2,440,099 | 4/1948 | Kind | 15/245 |
| 3,892,005 | 7/1975 | Berns . | |
| 4,075,730 | 2/1978 | Siemund . | |
| 4,430,769 | 2/1984 | Bergström . | |
| 4,697,296 | 10/1987 | Smahlik | 15/245 |
| 4,777,694 | 10/1988 | Young | 15/245 |

*Primary Examiner*—Edward L. Roberts

*Attorney, Agent, or Firm*—Lyon & Lyon

[57] ABSTRACT

A squeegee or like cleaning appliance, particularly for cleaning window panes and floors having a holder-handle assembly into which can be removably inserted a replaceable cleaning element. The holder is provided with a pivotally mounted fastening apparatus which directly contacts a removably inserted cleaning element that is somewhat rectangular in shape. The fastening apparatus has an open position and a closed position. To remove or insert the cleaning element, the fastener is pivoted to the open position wherein the fastening means does not exert force on the cleaning element. Once the cleaning element has been inserted into the holder, the fastener is moved to the closed position, the fastening apparatus exerting pressure upon the cleaning element. The holder is designed so that the fastener fits snugly when in the closed position. This prevents the cleaning element from sliding in the holder while being used. The fastening apparatus can be opened and closed repeatedly without losing its effectiveness.

4 Claims, 1 Drawing Sheet

FASTENING MECHANISM FOR SQUEEGEE HOLDER

BACKGROUND OF THE INVENTION

This invention relates to a squeegee or like cleaning appliance, particularly for cleaning window panes and floors.

Cleaning appliances such as squeegees are known in the art. The squeegee is especially effective at cleaning smooth surfaces that smear easily such as glass. The squeegee consists of a replaceable cleaning element, most commonly a rubber blade which effectively moves moisture across the glass surface, enabling the window to be thoroughly cleaned by removing all traces of moisture from the surface. One of the foremost problems in prior art devices has been the difficulty of inserting and removing the replaceable cleaning element, and holding the element in place while the squeegee is being used. Devices have been proposed which comprise clamping jaws coupled by an arm and urged apart by a coil spring. A widened outside end of this arm loosely bears against one clamping jaw whereas its other end is pivoted by a hand lever in the form of an eccentric. This permits the clamping jaws to be closed and locked contrary to the thrust of the coil spring. Other locking mechanisms such as one disclosed in U.S. Pat. No. 3,892,005 to Berns also require a complicated clamping mechanism to hold the rubber squeegee blade into the holder for the blade. The mechanism disclosed in 3,892,005 is bulky and over a period of time becomes less and less effective due to loss of tension in the metal components caused by periodic use.

Other clamping mechanisms in the prior art have a common feature, in that they cause the top surface and a bottom surface between which the squeegee is placed to exert force upon one another thereby clamping down on the squeegee in a vice-like fashion. Some devices utilize screws to draw the top and bottom surfaces together, clamping the replaceable cleaning element therebetween. This type of fastening apparatus is very difficult to use because it requires considerable time to tighten and loosen the screws and necessitates the use of a tool.

SUMMARY OF THE INVENTION

This invention relates to a mechanism that retains the rubber squeegee blade in place within a squeegee holder without requiring complex-tension inducing vice-like mechanisms that create a clamping force between the top surface and the bottom surface of a squeegee holder between which the rubber squeegee blade is placed. The object of the invention is to effectively retain the squeegee blade yet make the mechanism easy to use, and to be used repeatedly without losing any of its effectiveness.

To obtain these objectives, the invention provides a pivotally mounted fastening mechanism with a peg-like extended portion that, when closed, exerts force upon a replaceable cleaning element placed between the top surface and the bottom surface of a squeegee holder, a hole in the top surface enabling the peg to directly contact the surface of the replaceable cleaning element. When this element needs to be replaced, the fastening mechanism is opened, removing the peg from contact with the element, thereby allowing the element to be easily slid from the holder.

BRIEF DESCRIPTIONS OF THE DRAWINGS

DETAILED DESCRIPTION OF THE PREFERRED EMBODIMENT

Figure 1:
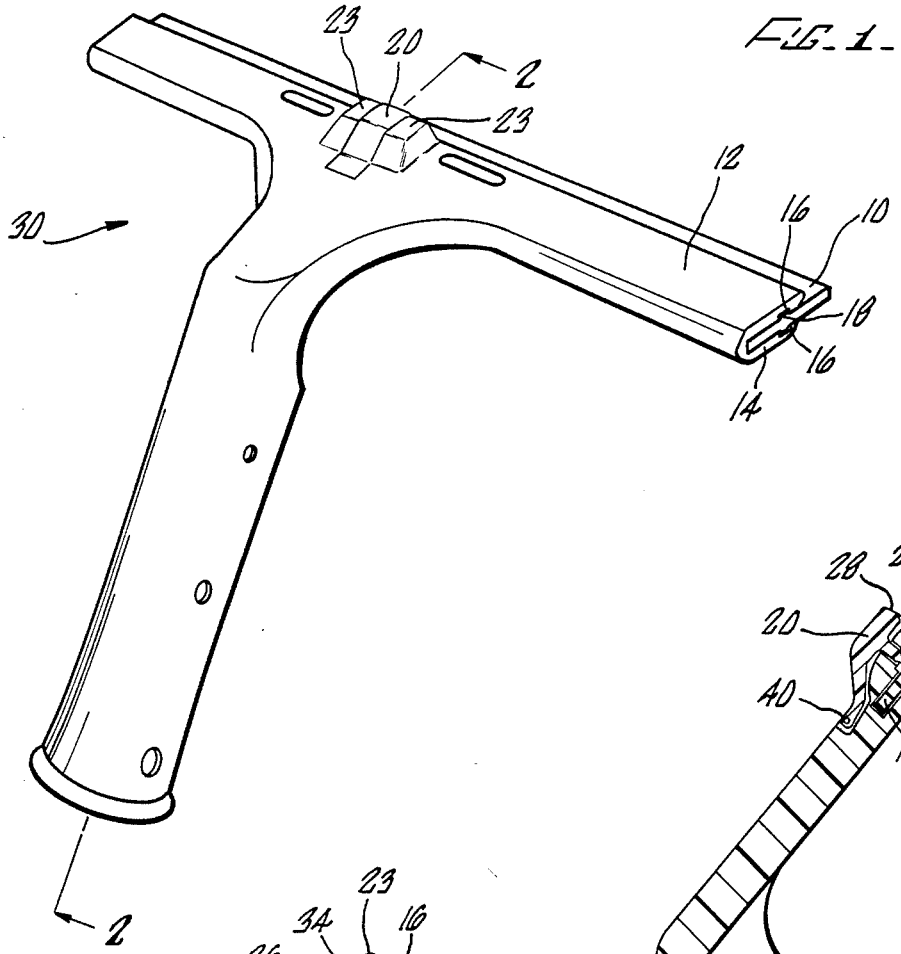
FIG. 1 is a plan view of the squeegee holder with the fastening mechanism in the closed position.
Figure 2:
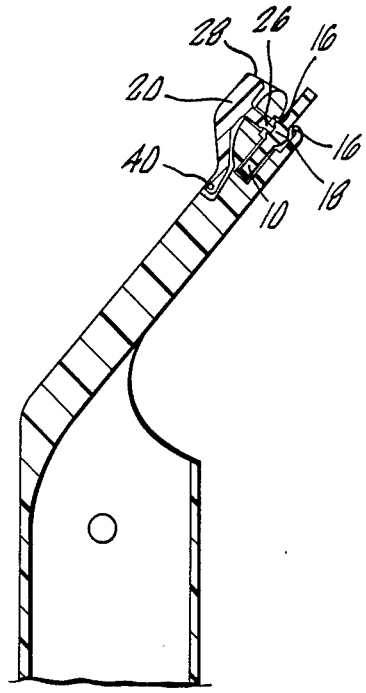
FIG. 2 is a cut away view along line 2—2 of FIG. 1 with the fastening mechanism in the closed position.

As depicted in FIG. 1 the invention consists of three primary components, the holder 30, the replaceable cleaning element 10 and the fastener 20. The holder has a top surface 12 and a bottom surface 14 between which the replaceable cleaning element 10 is removably inserted. For ease of insertion and for stability when inserted, the top surface and the bottom surface are provided with indentations 16 to accommodate the ridges 18 on the replaceable cleaning element 10.

In the center of the top surface 12 there is provided raised surfaces 23 which provide a smooth transition from the top surface 12 to the top of the fastener 20. The raised surfaces 23 define the space in which the fastener 20 is placed. The fastener 20 is pivotally mounted with hinge 40 atop surface 12 of the holder 30.

The fastener 20 is constructed so that it fits snugly between raised portions 23, yet can be easily pivoted when upward pressure is applied to surface 28 of the fastener 20 in order to raise the peg 26 from its closed position to its open position.

Figure 3:
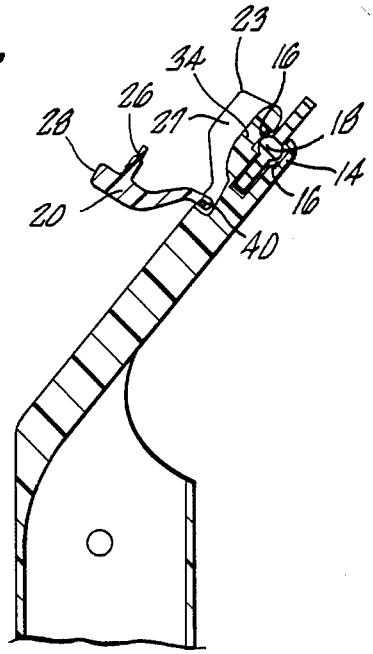
FIG. 3 is a cut away view as in FIG. 2 but with the fastening mechanism in the open position.

FIG. 3 depicts the holder 30 with the fastener 20 in the open position where it can be seen the fastener 20 is provided with a peg 26 which, when the fastener is closed, exerts pressure upon replaceable cleaning element 10 thereby causing it to remain in position. An indentation 27 is defined by raised surfaces 23 provided in the top surface 12 of the holder 30. This indentation has a hole 34 therein through which the peg 26 can contact the replaceable cleaning element 10 when the fastener 20 is in the closed position.

The foregoing detailed description is intended by means of example only. The invention is not intended to be limited except in the spirit and scope of the appended claims. The invention may be embodied in other specific forms without departing from the spirit or essential characteristics thereof.

What is claimed is:

1. A squeegee particularly suited for cleaning window panes and floors comprising:

a. a replaceable cleaning element;

b. a holder adapted to secure a replaceable cleaning element, said holder having a top surface and a bottom surface between which the replaceable cleaning element is removably placed;

c. a fastening means that is pivotally mounted on the top surface, the fastening means being capable of being pivoted from a first locking position to a second open position, the fastening means exerting a force upon the replaceable cleaning element when in the first locking position;

d. an aperture on the top surface so that the fastening means can directly contact the cleaning element placed between the top surface and the bottom surface.

2. A squeegee particularly suited for cleaning window panes and floors comprising:

a. a replaceable cleaning element;

b. a holder adapted to secure a replaceable cleaning element, said holder having a top surface and a bottom surface between which the replaceable cleaning element is removably placed;

c. a fastening means that is pivotally mounted on the top surface, being capable of being pivoted from a first locking position to a second open position, the fastening means exerting a force upon the replaceable cleaning element when in the first locking position;

d. a locking means on the top surface to hold the fastening means in place when in the first locking position.

3. The squeegee of claim 1 wherein the top and bottom surfaces have inward surfaces between which the replaceable cleaning element is interposed and which have indentations therein that run lengthwise, the indentations in both surfaces being substantially directly opposite each other.

4. The squeegee of claim 3, wherein the replaceable cleaning element has raised ridges which conform to the indentations in the inward surfaces of the top and bottom surfaces of the squeegee holder.

* * * * *